US006240567B1

(12) United States Patent
Johnston

(10) Patent No.: US 6,240,567 B1
(45) **Date of Patent: *Jun. 5, 2001**

(54) DISPOSABLE SAFETY HOOD HAVING UNIQUE AIR SUPPLY CONNECTOR

(75) Inventor: Thomas Joseph Johnston, Santa Ana, CA (US)

(73) Assignee: No Fade Coatings, Inc., Garden Grove, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/365,690

(22) Filed: Aug. 3, 1999

Related U.S. Application Data

(63) Continuation-in-part of application No. 09/039,085, filed on Mar. 11, 1998.

(51) Int. Cl.[7] ..... A42B 1/04
(52) U.S. Cl. ..... 2/202; 128/201.23
(58) Field of Search ..... 2/173.1, 202, 205, 2/410; 128/201.23, 201.25

(56) References Cited

U.S. PATENT DOCUMENTS

| | | | | |
|---|---|---|---|---|
| 296,499 | | 4/1884 | Wisniewski . | |
| D. 348,957 | | 7/1994 | Viemeister et al. | D29/15 |
| D. 382,084 | | 8/1997 | Ferroni | D29/107 |
| 1,262,566 | | 4/1918 | Rhodes et al. . | |
| 1,410,926 | | 3/1922 | Knoblock . | |
| 3,413,972 | | 12/1968 | Depping | 128/142.7 |
| 3,911,914 | | 10/1975 | Johansson | 128/142.7 |
| 3,943,575 | | 3/1976 | Bolker | 2/205 |
| 4,266,301 | | 5/1981 | Canda | 2/410 |
| 4,455,687 | | 6/1984 | Johansson | 2/424 |
| 4,619,254 | | 10/1986 | Moretti et al. | 128/201.23 |
| 4,627,431 | | 12/1986 | Werjefelt | 128/201.25 |
| 4,815,458 | | 3/1989 | Sing | 128/201.25 |
| 4,932,078 | | 6/1990 | Jones et al. | 2/70 |
| 5,005,216 | * | 4/1991 | Blackburn et al. | 2/79 |
| 5,022,095 | | 6/1991 | Fleury | 2/190 |
| 5,133,344 | | 7/1992 | Jurrius et al. | 128/201.23 |
| 5,226,409 | | 7/1993 | Bower et al. | 128/201.23 |

* cited by examiner

*Primary Examiner*—John J. Calvert
*Assistant Examiner*—Katherine Moran
(74) *Attorney, Agent, or Firm*—Cislo & Thomas LLP

(57) ABSTRACT

A safety hood for use in toxic ambient atmospheres, wherein the hood has a head portion and is formed in an economic manner and is entirely fabricated of a polymeric material and thus, is wholly disposable, and wherein an air passageway is integral with the head portion of the hood, and contains an air-permeable member throughout the substantial length thereof in order to prevent the collapse of the air passageway.

11 Claims, 2 Drawing Sheets

DISPOSABLE SAFETY HOOD HAVING UNIQUE AIR SUPPLY CONNECTOR

CROSS-REFERENCES TO RELATED APPLICATIONS

This Application is a continuation-part Application of pending application Ser. No. 09/039,085 filed Mar. 11, 1998.

BACKGROUND OF THE INVENTION

1. Field of the Invention

This invention relates to safety hoods of the type worn by workers in toxic or areas of contaminated air where there may be airborne particles, or even where hazardous vapors, acidic or the like may be present. In such environments, it is necessary to have a lightweight, inexpensive, air-impervious hood by which a worker in such contaminated areas may be supplied with breathable air and, wherein the safety hood is made of an air-impervious, synthetic material such as, one sold by DuPont Corporation, under the trademark TYVEK, for example. Preferably the hood should be wholly disposable. TYVEK is a material made available by DuPont and is a spun bonded polyolefin.

2. Description of the Related Art

Environmental concerns and regulations dictated by federal organizations such as, OSHA, make it mandatory for workers in hazardous vapor areas or where contaminants are in the ambient atmosphere as, for example, spray painting areas, chemical mixing areas, and the like, to have a supply of breathable air. The tack taken in the prior has been to have a safety hood or the like member with a visual lens that a worker may position over his or her head and, wherein a breathing tube air hose is connected to the hood and to a source of breathable air.

In the past, workers have had to discard the hood after a certain work period, and disassemble for example, the breathing tube from the hose, dispose of the hood and then, reassemble a new hood with the breathing tube so that work could continue either at the same shift or at a later shift, which could be the following day.

That is, the disposable hood portion would be discarded and a new hood associated with the breathing tube, which would then be utilized by the worker in a safe manner.

When the worker has had to disassociate for example, the breathing tube from the safety hood, a certain amount of cleaning is required should the end of the breathing tube be contaminated. In any event, the worker would have to disassociate the breathing tube from the disposable hood, which is usually held in place by a clamp or the like.

It can be readily seen that the aforedescribed procedure would not only be time-consuming, but would also involve a certain amount of possible cross-contamination, especially where a contaminated breathing tube is associated with a new hood.

Additionally, it has been found that the breathing tube or air hose when made of a conformable material tends to collapse upon itself. One aspect of the invention circumvents this problem.

SUMMARY AND OBJECTS OF THE INVENTION

With the herein disclosed invention, it is now possible to have a wholly disposable safety hood that does not require disassociation of the air tube for example, such that after use, the entire assemblage, i.e., hood and breathing tube may be disposed of. By providing a safety hood made of air-impermeable material, and having a conformable, pliable, air-impermeable air passageway in lieu of one that comprises a rigid plastic breathing tube that must be conserved and replaced, it is now possible to have an integral hood and air passageway, that is totally disposable and the dependability of the air passageway of which is greatly enhanced.

This invention relates to conformable material safety hoods and integral air passageway that is wholly disposable, lightweight, and relatively inexpensive to manufacture.

It is an object of the invention to provide a safety head-mounted hood that is wholly disposable for use in toxic or contaminated ambient atmospheres.

It is another important object of the invention to provide a head-mounted safety hood wherein air is funneled through an integrally connected air passageway to the safety hood, and wherein the entire hood and passageway are disposable.

It is another important object of the invention to provide a safety hood to furnish breathable air to the wearer thereof, wherein air is channeled through an air-impervious passageway, which is integrally and non-releasably associated with the safety hood, and wherein an air-permeable foam-like member extends and substantial length of the air passageway to not only insure its openness but also to act as an air filter for air being introduced into the air passageway.

It is still another important more specific object of the invention to provide a disposable hood having a lens-viewing area, and wherein an integral air-impervious passageway is provided with an internal foam supporting and filtering member through a portion thereof and is adapted to have a free end thereof connected to a source of breathable air, and wherein there is a sound-dampening foam component adjacent the coupling end of the air passageway.

These and further objects of the invention become apparent from reference to the following commentary taken in conjunction with the drawings.

A wholly disposable hood assembly for use in toxic and the like ambient lo atmospheres comprises the combination of a hood member which is supported on the head of the wearer of pliable, air-impermeable material, having a viewing area by which a person wearing a hood may see. An elongate air member of pliable, air-impermeable material forms an air passageway, and is integral with the hood, and is non-releasable therefrom, and has one end operatively connected thereto with the other end being adapted to be connected to a source of breathable air to be supplied to the wearer of the hood. In another embodiment an air-permeable member is disposed within and occupies a major portion of the interior of the elongate air member forming the air passageway.

The prior art such as, U.S. Pat. No. 4,619,254, issued to the E.D. Bullard Company, teaches a protective respirator hood having the usual air hose which is ordinarily of plastic material having a coil-spring wire encased within with one end being connected to the hood with the opposed end being connected to a source of breathable air. Thus, the air is actually conducted through a plastic tube, which is ordinarily conserved by the user of the hood by detachment therefrom, and reuse with a new hood. In other instances of the prior art, this air hose has been covered entirely with an air-impermeable sheath, which encases the plastic air hose as described above. However, none of the prior art has an integral hood and air passageway made of the same material, wherein the hood is wholly disposable. Neither does the prior art teach an air hose of conformable material having a foam support and filter member therein.

The prior art found comprises:

| PAT. NO. | INVENTOR | ISSUED |
|---|---|---|
| 3,943,575 | Bolker | Mar. 16, 1976 |
| 4,266,301 | Canda | May 12, 1981 |
| 4,455,687 | Johansson | Jun. 26, 1984 |
| 4,627,431 | Werjefelt | Dec. 09, 1986 |
| 4,932,078 | Jones et al. | Jun. 12, 1990 |
| 5,022,095 | Fleury | Jun. 11, 1991 |
| 5,133,344 | Jurrius et al. | Jul. 28, 1992 |
| 5,226,409 | Bower et al. | Jul. 13, 1993 |
| D348,957 | Viemeister et al. | Jul. 19, 1994 |
| D382,084 | Ferroni | Aug. 05, 1997 |

DESCRIPTION OF THE PREFERRED EMBODIMENT(S)

Figure 1:
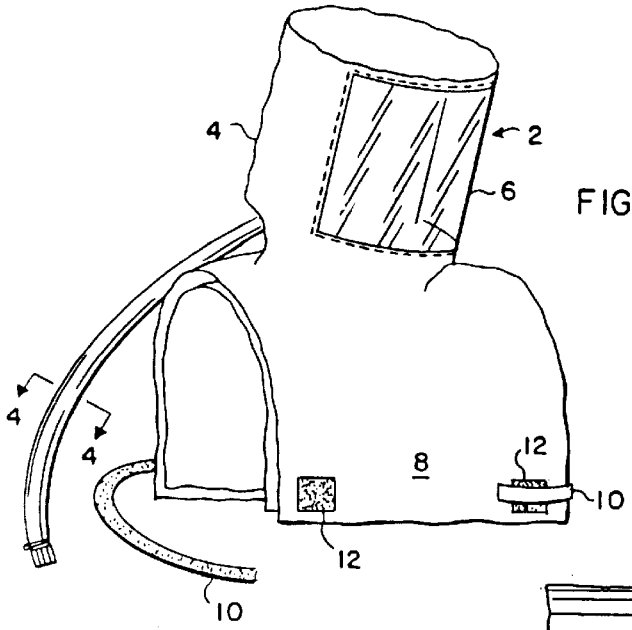
FIG. 1 is a perspective view showing the safety hood of this invention.
Figure 2:
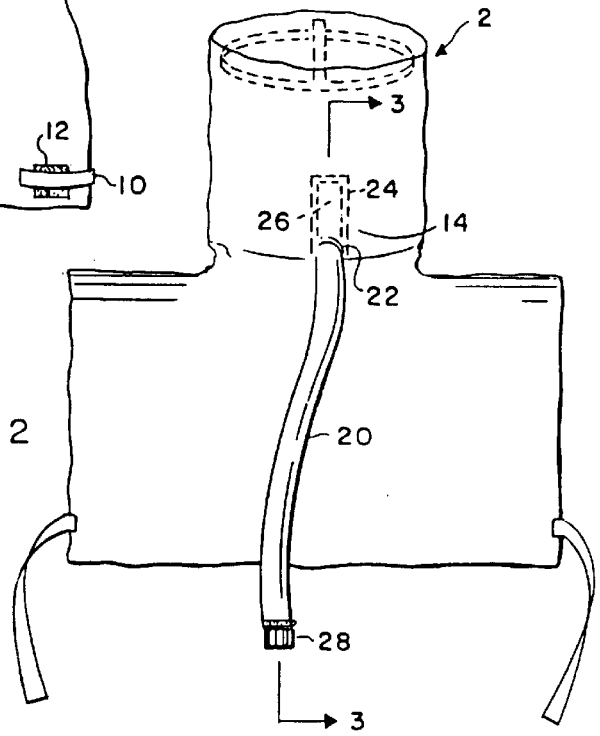
FIG. 2 is a rear view of the safety hood of this invention.
Figure 3:
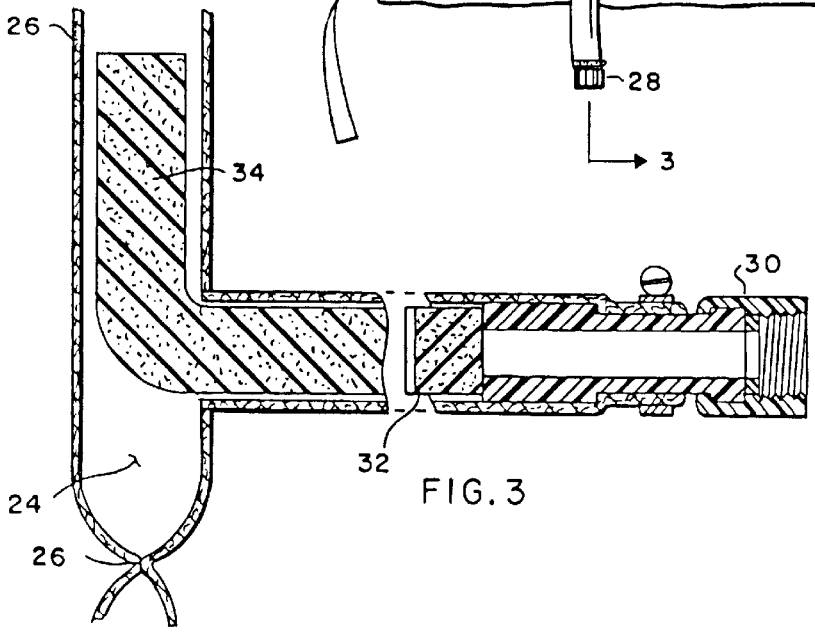
FIG. 3 is a partial schematic enlarged view of the air passageway portion of the safety hood of this invention.

Referring to the drawings, wherein like numerals of reference designate like elements throughout, it will be seen that the safety hood 2 of this invention, comprises what may be considered a head portion 4 having the usual plastic lens viewing panel 6 with a downwardly extending bib like portion 8 having strips 10 with VELCRO segments 12, by which the safety hood 2 may be secured to a wearer. VELCRO is a hook and loop-type fastener manufactured under the brand name VELCRO. In the interior of head portion 4 of hood 2, secured as by VELCRO fasteners or the like, is a head suspension member which are like those in the prior art comprising what may be termed lightweight plastic head band type members with or without appropriate foam material for comfort and which may be attached to the interior of the head portion 4 of hood 2 by means of VELCRO strips (FIG. 2). Those in the art are very familiar with this type of lightweight head suspension that may be used in conjunction with the safety hood 2 and thus, no details of construction nor specifics thereof will be delved in further. Of course, it should be understood that the safety hood 2 may be utilized for its intended purposes without such a head suspension, but obviously the presence of a head suspension and the manner of attachment makes the safety hood 2 easier to utilize in relative comfort.

The safety hood 2 is seen as being made entirely, in this particular instance, of white polycoated TYVEK with a relatively large viewing lens that is sewn into the viewing lens 6 which is sewn into the head portion 4 of the hood, and which may be 15 mil polyethylene terephalate glycol. Preferably, the comers of the lens 6 are provided with a ½ inch radiused corners to prevent cutting into the TYVEK.

As indicated, the VELCRO tabs 12 and TYVEK strips 10 are sewn into the bib area 8 in order to help keep the safety hood 2 in place during use.

Extending from the rear 14 of hood 2 is an extending, down or breathing tube or elongate member 20, also formed of TYVEK, and having a first end 22 which extends into the back 14 of head portion 4 of hood 2 and specifically into an air channel 24 formed by sewing a TYVEK flap 26 in the interior thereof so that air, as will be explained hereinafter, is funneled through channel 24 over the back of the head of the wearer of the safety hood 2, and downward over the interior surface of lens 6 to prevent the same from fogging up, as those familiar in the art will well recognize.

The elongate member 20 has an opposed end 28 which may be connected via a hose connector 30 which is adapted to be connected to a source, not shown, of breathable air. Referring to FIG. 2, it will be noted that elongate member 20 is at least twice as long as the height of head portion 4 of hood 2. Additionally, the diameter (where the elongate member is cylindrical) of elongate member 20 is at least one inch.

Upstream of end 28 just past the connector assembly 30 is positioned about a one inch long, in this instance of sound-dampening material 32, square in cross-section, and being of porous foam material having the general characteristics of a foam grade GA 65165-835, which has a density of 1.65 lbs./cubic foot. The GA 65165 grad foam is an ester like ether (ele) foam. It has an ILD of 60–70 lbs./square inch at 25 % compression, 30% open cell, with a cell count of 60–70 ppi.

Disposed further upstream of sound-dampening block 32 and extending the entire length of elongate member 20 from first end 22 to opposed end 28, and into channel 26, is a breathing tube support foam member 34 of foam material, generally being one inch square in cross-section and about 36 inches long, and approximately 97% open cell with a cell count of about 50 ppi and a density of 1.4 pounds per cubic foot, and having a porosity of T-50. This down or breathing support foam member 34 is about 36 inches in length and is anchored at its end 36 adjacent sound suppressing foam block 32 by means of pin 38 which is anchored at the end of 36 so as to prevent the same from being blown into the interior of safety hood 2, when air under pressure is introduced to the air passageway 20 via the connector 30.

The elongate member 20 is also made of TYVEK and in order to ensure that the pliable, conformable material forming the air passageway 20 does not collapse, the foam member 36 is utilized and which also provides some sound-dampening capability, as well as allowing the passage of breathable air through elongate member or passageway 20 into the interior of safety hood 2.

Figure 4:
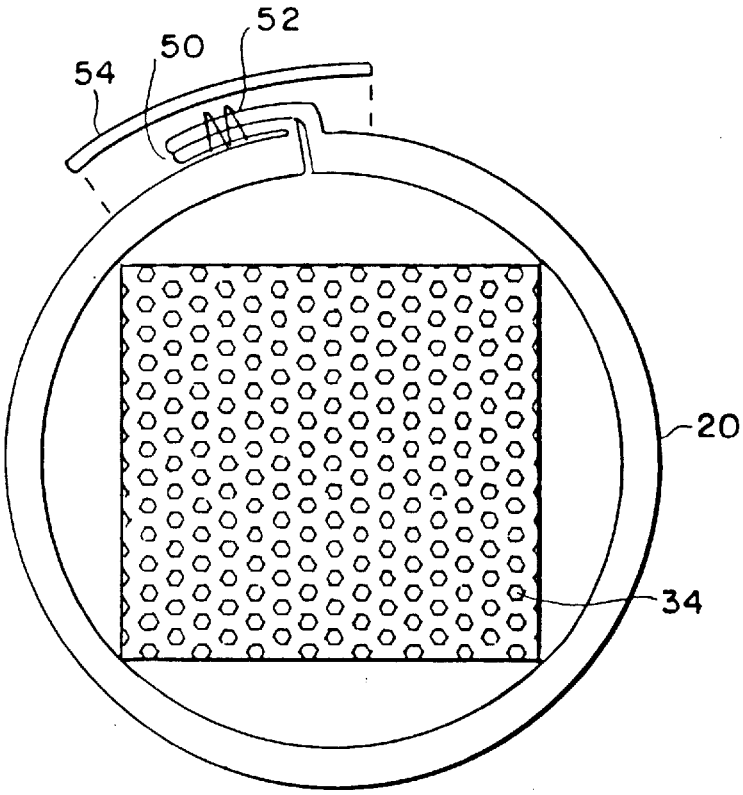
FIG. 4 is a cross-section taken along the lines 4—4 of FIG. 1.
Figure 5:
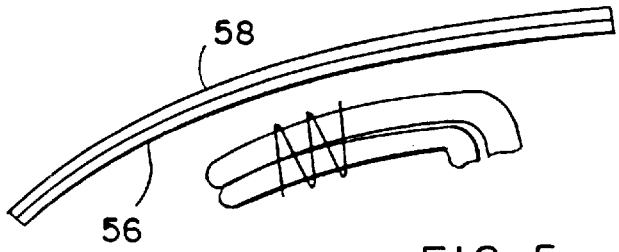
FIG. 5 is an enlarged and partial exploded view showing the same area as in FIG. 4 of the air passageway of the invention.
Figure 6:
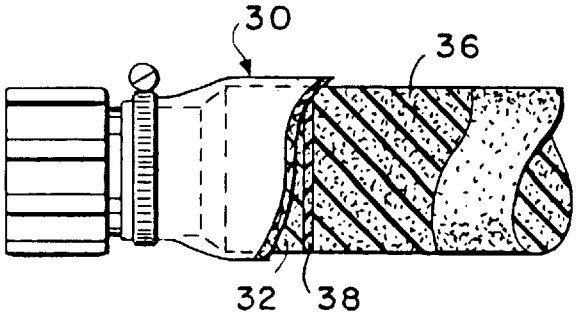
FIG. 6 is an enlarged, partial cross-sectional view showing more detail of the connector assembly.

Referring to FIGS. 4 and 5, it will be seen that the elongate member, down or breathing tube 20 is produced by utilizing a heat tape seal seam. That is, two plies of material 50 are sewn together with a 5-thread safety stitch 52, as shown in FIGS. 4 and 5, and the seam thus formed is then overlaid with a section of barrier tape 54, extending the entire length of down or breathing tube 20, and is heat sealed under heat and pressure over a short period of time, as those of ordinary skill in the art will recognize with regard to the materials involved.

The heat sealed seam sealing tape 54 is a 2-layer film tape designed to provide maximum barrier to harsh chemical environments within which the safety hood 2 may be used. More specifically, the heat sealed tape 54 is formulated to bond to polyolefin non-wovens, such as TYVEK. In this particular instance, the tape 54 has a point 0.005 inch thick adhesive layer 56 with a 0.00075 inch barrier layer of saran coated polypropylene 58. The tape 54 is about ⅞ inch wide, but this of course will vary depending upon manufacturing conditions and the size of the folded over polycoated TYVEK when sewn as shown in FIGS. 4 and 5.

Thus, a safety hood 2 is disclosed which is wholly disposable and which is almost entirely made of material such as TYVEK, although those of ordinary skill in the art will recognize that TYVEK is a trademark product and that there are other air impervious synthetic materials having the same or similar properties that may be utilized without departing from the spirit and scope of the invention.

Suffice to say, that a safety hood 2 fabricated as previously described provides the user thereof with adequate protection for working in hazardous environments and yet being provided with at least Grade D breathing air which is supplied by means of connector 30 to the source of air, not shown. Those of ordinary skill in the art will also recognize that in lieu of the connector 30 a ¼ inch or ⅜ inch NPT quick connect connector can be utilized to connect directly to an air line or any other air source that is also equipped with quick connect and disconnect fittings.

Thus, there is described a safety hood that provides breathable air through a TYVEK constructed down or breathing tube which is held in the open position by means of a one inch square elongate foam member 34, to prevent the possibility of airflow restriction by either the tube being twisted or bent, and also projects several inches into the air channel 26 to help support the connection point of the down tube 20 to the rear 14 of safety hood 2. This foam member 34 also acts as a sound suppressor, but because of its porosity to allow foam flow, it ideally requires an additional sound suppressor of high density foam, such as member 32. The rectangular sound suppressor 32 lowers the sound levels that may come from either a cooling vortex or an air flow adjustment regulator, which is part of the air supply system not shown.

Thus, in operation breathable air is supplied to the down or breathing tube 20, which flows up the air channel formed by the same and over and around the user's head, which as indicated helps in defogging the lens 6 by passing in a downwardly direction the incoming air which also reduces $CO_2$ build up that can occur inside of safety hood 2.

Thus, there has been described a safety hood that is wholly disposable of light weight material and which has unique sound dampening qualities as well as unique fabrication methods so as to ensure the safety of the wearer of the safety hood.

Those of ordinary skill in the art will recognize that various modifications and changes will suggest themselves over the specific example described and illustrated herein, and all such changes and modifications are intended to be covered by the appended claims.

I claim:

1. A wholly disposable hood assembly for use in toxic and the like ambient atmospheres, consisting of the combination of:

a hood member having a head portion of pliable, air-impermeable material said head portion having a view area by which a person wearing the hood may see; a singular elongate air member of pliable, air-impermeable material forming an air passageway and having one end operatively connected to the rear of said hood member with the other end being adapated to be connected to a source of breathable air to be supplied to a person wearing said hood member, said singular, elongate air member being at least twice as long as the height of said head portion of said hood member.

2. The hood, in accordance with claim 1, wherein there is included an air-permeable member disposed within and occupying a major portion of the interior of said elongate air member, and said pliable, air-impermeable material is conformable.

3. The hood, in accordance with claim 2, wherein said air-permeable member is of foam-like material.

4. The hood, in accordance with claim 3, wherein said air-permeable member is about square in cross-section.

5. The hood, in accordance with claim 3, wherein said air member is tubular in configuration.

6. The hood, in accordance with claim 5, wherein said hood also includes a head support member adapted to support said hood on the head of a wearer.

7. The hood, in accordance with claim 6, which additionally includes a section of sound-dampening material adjacent to said other end of said air member.

8. The hood, in accordance with claim 7, which includes an extending portion of said air-impermeable member that extends upwardly and inwardly into a channel formed in the back portion of said head portion of said hood member.

9. The hood, in accordance with claim 8, wherein said pliable, air-impermeable material is spun bonded polyolefin.

10. The hood, in accordance with claim 9, wherein said hood includes fastening means by which said hood may be releasably secured to a wearer thereof.

11. A wholly disposable hood assembly for use in toxic and the like ambient atmospheres, comprising the combination of:

a hood member having a head portion of pliable, air-impermeable material said head portion having a viewing area by which a person wearing the hood may see; an elongate air member of pliable, air-impermeable material forming an air passageway and having one end operatively connected to said hood member with the other end being adapted to be connected to a source of breathable air to be supplied to a person wearing said hood member, said singular, elongate air member having an effective internal diameter of at least one inch and being about twice as long as the height of said head portion of said hood member.

* * * * *